US006361625B2

(12) United States Patent
Fujikake et al.

(10) Patent No.: US 6,361,625 B2
(45) Date of Patent: Mar. 26, 2002

(54) HIGH-STRENGTH, DAMAGE-RESISTANT RAIL HAVING HARDNESS DISTRIBUTION OF EXCELLENT DAMAGE-RESISTANCE AT ITS HEAD TOP PORTION

(75) Inventors: Masahisa Fujikake; Jun Furukawa; Kiyotaka Morioka; Kozo Fukuda; Hideyuki Yamanaka; Kazutaka Kobayashi; Shinichi Nagahashi, all of Tokyo (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/231,440

(22) Filed: Jan. 14, 1999

Related U.S. Application Data

(63) Continuation-in-part of application No. 08/785,647, filed on Jan. 17, 1997, now abandoned.

(30) Foreign Application Priority Data

Jul. 4, 1996 (JP) ..... 8-174807

(51) Int. Cl.[7] ..... C21D 1/18

(52) U.S. Cl. ..... 148/333; 148/334; 148/335; 148/336; 148/581

(58) Field of Search ..... 148/320, 333, 148/334, 335, 336, 581, 660

(56) References Cited

U.S. PATENT DOCUMENTS 5,209,792 A 5/1993 Besch et al. ..... 148/581

*Primary Examiner*—Sikyin Ip
(74) *Attorney, Agent, or Firm*—Frishauf, Holtz, Goodman, Langer & Chick, P.C.

(57) ABSTRACT

A high-strength, high damage-resistant rail made of 0.6 to 0.85 wt % C, 0.1 to 1.0 wt % Si, 0.5 to 1.5 wt % Mn, 0.035 wt % or less P, 0.040 wt % or less S, and 0.05 wt % or less Al, with the balance being Fe and inevitable impurities, and having corner and head side portions having a Brinell hardness of 341 to 405, and a head top portion in which a Brinell hardness of a site 20-mm distant from the central portion of the head top portion in a width direction is 341 to 405, and a hardness of the central portion of the head top portion is at least 10 lower in Brinell hardness than that of the site 20-mm distant from the central portion.

22 Claims, 5 Drawing Sheets

HIGH-STRENGTH, DAMAGE-RESISTANT RAIL HAVING HARDNESS DISTRIBUTION OF EXCELLENT DAMAGE-RESISTANCE AT ITS HEAD TOP PORTION

This application is a continuation-in-part application of application Ser. No. 08/785,647, filed Jan. 17, 1997, now abandoned.

BACKGROUND OF THE INVENTION

1. Field of the Invention

The present invention relates to an anti-wear, high-strength, damage-resistant rail used for sharp curves of a high-axle load railroad, more particularly, to a high-strength, damage-resistant rail in which the resistance to damage to a head top portion thereof is improved.

2. Background Information

A head of a rail has a head top portion, corner portions, head side portions and jaws. A conventional anti-wear, high-strength rail used in a track of sharp curves of a high-axle load railroad which uses wooden crossties is heat-treated such that the hardness of the corner and head side portions is equal to that of the head top portion. Therefore, the anti-wear properties of the rail corner portions are the same as those of the rail head portion.

However, contact between the wheels and the rails is complicated, and the contact pressure varies depending on the position of the rail head-wheel contact. In a sharp curve of a high-axle load railroad, large slip forces act on a rail gauge corner portion (i.e., an inner corner portion) and the rail head side surfaces. However, a large contact pressure acts on the rail head top portion and the rail gauge corner portion. As a result, the rail gauge corner portion and the rail head side portions of the conventional anti-wear, high-strength rail are worn much more than the rail head top portion. Therefore, the rail head top portion is always worn much less than the rail gauge corner portion, and a maximum contact pressure from each wheel acts on the central less-worn portion of the rail head top portion.

Since the contact state between the wheels and the conventional anti-wear, high-strength rail having uniform wear properties of the rail head is as described above, it takes a long period of time to fit rails to the wheels during an initial period of use of the rails. A local excessive contact stress lasts for a long period of time, and defects caused by fatigue tend to be formed. Even after the rails are brought into satisfactory fitness to the wheels, a maximum contact pressure acts on the rail head top portion of each rail. Decisive problems are not posed in this condition when wooden crossties are used to form a track. However, when concrete crossties are used to form a highly rigid track, an impactive maximum contact pressure generated upon passing of a rolling stock is increased. Therefore, damage called the surface contact fatigue typically occurs in the central rail head top portion.

In order to prevent the head check according to a conventional technique, a method of grinding and correcting a rail head surface layer prior to accumulation of fatigue in the rails is employed. However, this operation is time-consuming and costly. In addition, it is also difficult to determine an optimal grinding/correcting time.

In the meantime, U.S. Pat. No. 5,209,792 discloses a rail capable of preventing a head check generated in the center portion of the head top portion. This rail is formed such that the hardness of each of the corner portion and the head side portion is high, and the hardness of the head top portion is made 0.9 or less of that of either the corner portion or the head side portion. Thus, the hardness of the head top portion is decreased so as to raise the wearing rate of that portion, and the contact force at the head top portion is dispersed to lower the maximum contact stress, thus reducing the damage to the head top portion.

However, the generation of the damage to the head top portion depends on the contact stress, and the contact stress and its distribution depend on the distribution of the wearing speed of the head top portion, that is, the distribution of the head top portion in the rail width direction. Therefore, even if the range of the hardness of each of the corner portion and the head side portion, and the range of the hardness of the head top portion are defined as in U.S. Pat. No. 5,209,792, the damage reducing effect cannot always be obtained, or the life of rail may not be prolonged.

BRIEF SUMMARY OF THE INVENTION

The present invention has been proposed so as to solve the above-described drawbacks of the high-axle load railroad, and the object thereof is to provide a long-life high-strength, damage-resistant rail, the rail head top portion of which has an appropriate hardness distribution, in which a fatigue accumulation is not locally concentrated on the rail head top portion, the contact fatigue damage resistance is excellent, thereby capable of reducing the maintenance cost of track.

According to a first aspect of the present invention, there is provided a high-strength, high damage-resistant rail consisting essentially of 0.6 to 0.85 wt % of C, 0.1 to 1.0 wt % of Si, 0.5 to 1.5 wt % of Mn, 0.035 wt % or less of P, 0.040 wt % or less of S, and 0.05 wt % or less of Al, the balance being Fe and inevitable impurities, and comprising corner and head side portions having a Brinell hardness ($H_B$) of 341 to 405, and a head top portion in which a Brinell hardness of a site 20-mm distant from a central portion of the head top portion in a width direction is 341 to 405, and a hardness of the central portion of the head top portion is at least 10 lower in Brinell hardness (and preferably at least 10 to 50 lower in Brinell hardness), than that of the-site 20-mm distant from the central portion, a ratio of $$\frac{\text{the difference between}\begin{pmatrix}\text{the Brinell hardness of}\\ \text{the central portion of}\\ \text{the head top portion}\end{pmatrix}\text{and}\begin{pmatrix}\text{the Brinell hardness of}\\ \text{the site 20-mm distant}\\ \text{from the central portion}\end{pmatrix}}{\begin{pmatrix}\text{the Brinell hardness of the site}\\ \text{20-mm distant from the central portion}\end{pmatrix}}$$

being 0.1 or less (preferably 0.09 or less), a hardness of a section between the central portion of the head top portion and the site 20-mm distant from the center in the width direction increases gradually from the central portion towards an outer side of the width direction, and a difference between an actual hardness of the section, and a hardness obtained by interpolating the hardness of the central portion of the head top portion and the hardness of the site 20-mm away from the center in the width direction by a straight line, is 10 or less in Brinell hardness.

According to a second aspect of the invention, there is provided a high-strength, high damage-resistant rail consisting essentially of 0.6 to 0.85 wt % of C, 0.1 to 1.0 wt % of Si, 0.5 to 1.5 wt % of Mn, 0.035 wt % or less of P, 0.04 wt % or less of S, and 0.05 wt % or less of Al, containing at least one of 0.05 to 1.5 wt % of Cr, 0.01 to 0.20 wt % of Mo, 0.01 to 0.10 wt % of V, 0.1 to 1.0 wt % of Ni and 0.005 to 0.15 wt % of Nb, the balance being Fe and inevitable impurities, and comprising corner and head side portions having a Brinell hardness ($H_B$) of 341 to 405, and a head top portion in which a Brinell hardness of a site 20-mm distant from a central portion of the head top portion in a width direction is 341 to 405, and a hardness of the central portion of the head top portion is at least 10 lower in Brinell hardness (and preferably at least 10 to 50 lower in Brinell hardness), than that of the site 20-mm distant from the central portion, a ratio of $$\text{the difference between}\begin{pmatrix}\text{the Brinell hardness of}\\ \text{the central portion of}\\ \text{the head top portion}\end{pmatrix}\text{and}\ \frac{\begin{pmatrix}\text{the Brinell hardness of}\\ \text{the site 20-mm distant}\\ \text{from the central portion}\end{pmatrix}}{\begin{pmatrix}\text{the Brinell hardness of the site}\\ \text{20-mm distant from the central portion}\end{pmatrix}}$$

being 0.1 or less (preferably 0.09 or less), a hardness of a section between the central portion of the head top portion and the site 20-mm away from the center in the width direction increases gradually from the central portion towards an outer side of the width direction, and a difference between an actual hardness of the section, and a hardness obtained by interpolating the hardness of the central portion of the head top portion and the hardness of the site 20-mm distant from the center in the width direction by a straight line, is 10 or less in Brinell hardness.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The occurrence of damage to a rail head top portion depends on the contact stress, and the contact stress and its distribution vary as the fitting proceeds due to wear. The variation process depends on the distribution of the wear rate, that is, the hardness distribution in the rail width direction.

According to the studies of the present inventors, it has been formed that the damage can be significantly reduced by the technique disclosed in the above U.S. Pat. No. 5,209,792 only if the hardness distribution is appropriate, and that, with an inappropriate distribution, a local concentration of contact stress occurs as the fitting proceeds due to wear, thereby possibly vanishing the damage reduction effect.

More specifically, U.S. Pat. No. 5,209,792 discloses only the range of the hardness of each of the corner portion and the head side portion, and the range of the hardness of the head top portion, and makes no mention of the hardness distribution in the rail width direction. Therefore, such a hardness distribution that the contact stress at the head top portion and its distribution are rendered appropriate, may not be obtained.

In the above U.S. Pat No. 5,209,792, the hardness of the head top portion is defined to be 0.9 or less of that of the corner portion and the head side portion. With this structure, the contact stress of the head top portion is in fact significantly reduced. However, according to the intensive studies of the present inventors, it has been found that if there is such a large difference in hardness between the head top portion and the corner portion, a large contact stress may be generated at the end portion of the contact portion, which is located away from the center of the contact portion in the width direction, in reaction to the significant reduction of the contact stress at the center of the contact portion, and damage may occur and increase at the site. As a result, the life of the rail as a whole cannot be prolonged.

In the present invention, as described above, the hardness distribution of the rail head top portion in the width direction is controlled, and the variation of the contact stress, which takes place as the fitting progresses is controlled. Thus, a local concentration of fatigue accumulation at the head top portion of the rail can be avoided, thereby improving the contact fatigue damage resistance of the head top portion of the rail used under the circumstances of a high-rigidity track.

The present invention will now be described in detail.

Figure 1:
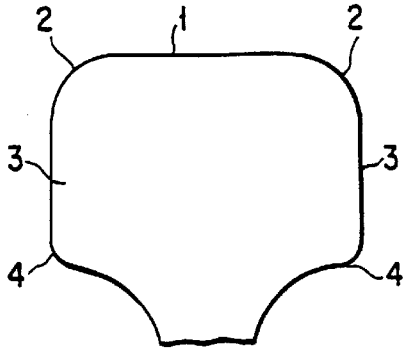
FIG. 1 is a cross section of a head portion of a rail according to the present invention.

FIG. 1 is a sectional view showing a head of a high-strength, damage-resistant rail according to the present invention. The rail head comprises a head top portion 1 corner portions 2, head side portions 3 and jaw portions 4. One of the corner portions 2 serves as a gauge corner portion which is brought into contact with each wheel during use of the rail.

Figure 2A:
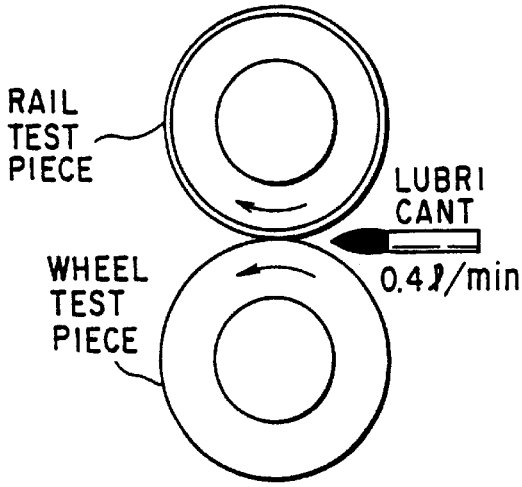
FIGS. 2A and 2B are explanatory diagrams which illustrate a 2-cylinder rolling contact test for examining the relationship between the vertical load acting on a rail, and the damage life thereof.
Figure 2B:
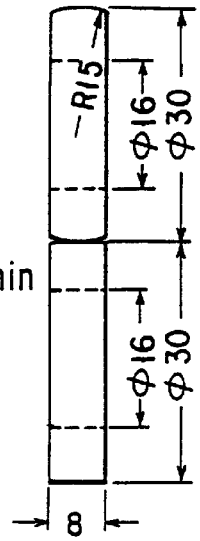
Figure 3:
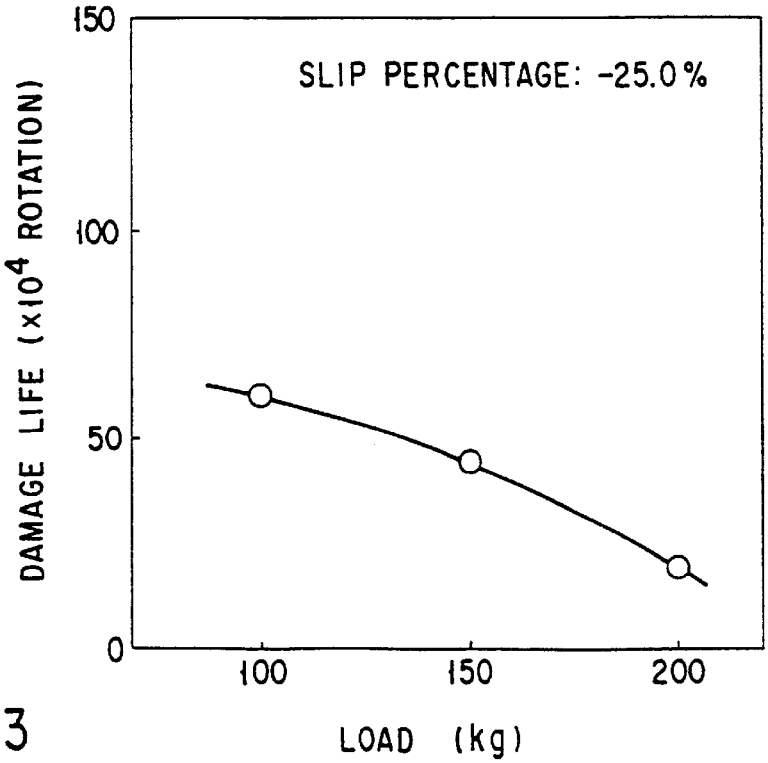
FIG. 3 is a graph showing the relationship between the vertical load applied on a rail, and the damage life.

Damage to the rail, especially, the head check to the head top portion 1 occurs within a short period of time when a contact stress acting on the rail head is increased. This will be described with reference to FIGS. 2A, 2B and 3. FIGS. 2A and 2B show a 2-cylinder rolling contact fatigue test using a rail test piece having a contact radius of curvature of 15 mm and a maximum diameter of 30 mm and a wheel test piece having a diameter of 30 mm. A relationship between a vertical load and a damage life is obtained, as shown in FIG. 3. When a vertical load is large, i.e., when a contact stress is large, it can be confirmed that damage occurs within a short period of time (i.e., the damage life is short).

When the wheel is brought into unsatisfactory rolling contact with a new high-strength rail or a high-strength rail after being ground and corrected in the initial period of use, a vertical load is concentrated on the rail, and damage tends to occur in the rail. When a rail portion which is brought into contact with a wheel has a shape, due to wear, which allows satisfactory fitness to the wheel, a vertical stress acts on a portion of the rail in which a wear rate is small. Judging from the above facts, in order to prolong the rail life, it is effective to disperse a maximum vertical stress acting severely on the conventional rail head top surface. This stress acts on the surface due to a lower wear rate.

In order to retard the head check of the head top portion 1, a contact pressure from a wheel is controlled not to be concentrated on a specific rail portion.

In the present invention, the maximum contact stress acting on the rail head top portion is reduced while maintaining the strength for supporting rail cars and anti-wear property. To achieve this, the rail composition is controlled, and the hardness of the corner and head side portions of the rail is set to be higher than that of the head top portion, and the difference in hardness between the center of the head top portion and the site 20-mm away therefrom in the width direction and the hardness distribution of the section therebetween are optimized. With this structure, the contact stress does not have a local high peak in the fitting process due to wear, and therefore it can be appropriately dispersed. Thus, the local concentration of fatigue accumulation can be prevented.

The rail composition according to the present invention is limited for the following reasons.

The content of C falls within the range of 0.60 to 0.85 wt %. When the content of C is 0.6 wt % or more, a high strength and an excellent anti-wear property can be expected. However, when the content of C exceeds 0.85 wt %, precipitation of the primary cementite causes degradation of toughness.

The content of Si falls within the range of 0.1 to 1.0 wt %. The content of Si must be at least 0.1% to assure the rail strength. However, when the content exceeds 1.0%, the toughness and weldability are degraded.

The content of Mn falls within the range of 0.5 to 1.5 wt %. The content of Mn must be at least 0.5 wt % to assure the rail strength. However, when the content exceeds 1.5%, the toughness and weldability are degraded.

The content of P is 0.03 wt % or less and of S is 0.040 wt % or less to prevent degradation of ductility.

The upper limit of the content of Al is 0.05 wt % since aluminum is a component which degrades the fatigue property.

As for rails used under severe conditions for contact between rails and wheels, at least one of Cr, Mo, V, Ni and Nb is added in the form of a low-alloy.

The content of Cr falls within the range of 0.05 to 1.50 wt %. When the content is 0.5 wt % or more, the interlamellar spacing of pearlite can be reduced to obtain a fine pearlite, thereby improving an anti-wear property and resistance to damage. However, when the content exceeds 1.50 wt %, the weldability is degraded.

The content of Mo falls within the range of 0.01 to 0.2 wt %. Mo is an element for increasing the strength as in Cr. This effect is exhibited when its content is 0.01% or more. However, the content exceeds 0.2 wt %, the weldability is degraded.

Nb and V are elements for precipitation hardening. The contents of Nb and v fall within the ranges of 0.005 to 0.15 wt % and 0.01 to 0.10 wt %, respectively. In order to obtain an effect as precipitation hardening elements, the content of Nb is 0.005 wt % or more, and the content of V is 0.01% or more. However, when the contents of Nb and V exceed 0.15 wt % and 0.10 wt %, respectively, a coarse Nb or V carbonitride is precipitated to degrade the toughness of the rail.

Ni is an element for improving the strength and toughness. The content of Ni falls within the range of 0.1 to 1.0 wt %. If the content is less than 0.1 wt %, no good effect is exhibited. However, the effect is saturated when the content is 1.0 wt %.

The rail according to the present invention has the component and composition described above and has a fine pearlitic structure. As described above, according to the present invention, the hardness distribution of the rail head is adjusted to control the anti-wear properties of the respective portions of the rail. The maximum contact pressure level is lowered, and head check damage to the rail head top portion which is caused by a high contact pressure in a highly rigid track can be suppressed. A preferable hardness distribution can be achieved by adjusting a heat treatment of each portion.

Figure 4:
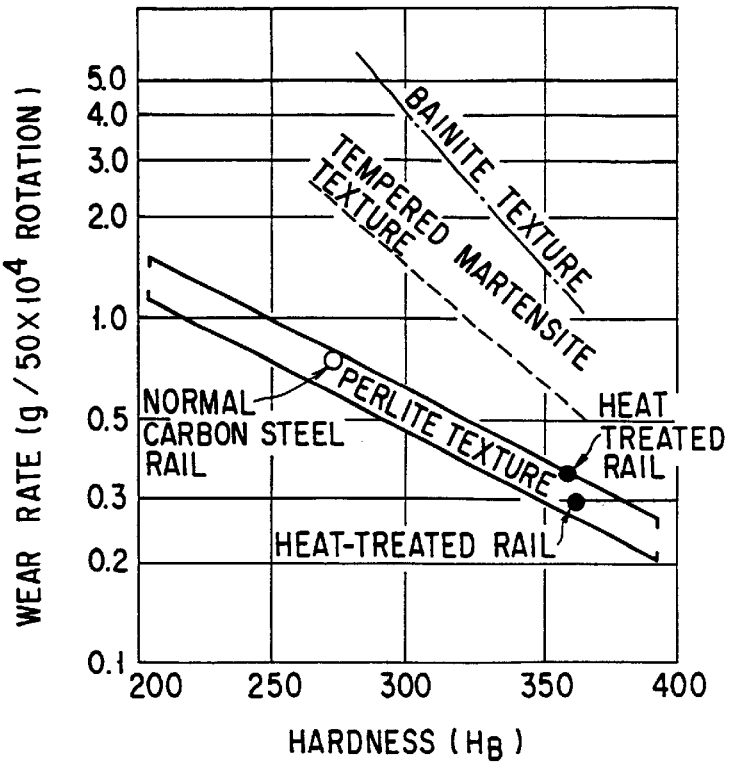
FIG. 4 is a graph showing the relationship between the hardness and the wear rate, and the relationship between the structure and the wear rate in the two-cylinder rolling contact wear test.

The same effect as described above can be obtained even if a metallurgical structure of the head top portion is changed to adjust a wear rate. More specifically, according to the present invention, the hardness distribution of the rail is adjusted by an appropriate treatment under the assumption of a fine pearlitic structure. However, by changing the metallurgical structure, the anti-wear property can be controlled regardless of its hardness. For example, as shown in FIG. 4, when the hardness value is kept unchanged, the fine pearlitic structure has the best anti-wear property. As shown in FIG. 4, it is possible to increase a wear rate while the hardness is increased to improve the fatigue strength upon control of the metallurgical structure.

The hardness of the rail of the fine pearlitic structure is specified in the present invention for the following reasons.

The hardness of the rail corner portions and head side portions are set within a range of $H_B$341 to $H_B$405, so as to assure the strength and anti-wear property of the rail.

The hardness distribution of the head top portion is as described below. That is, the hardness of the site 20-mm away from the center of the top portion of the head top portion in the width direction is in a range of $H_B$341 to $H_B$405, and the hardness of the center portion of the head top portion is 10 to 50 lower in Brinell hardness, than that of the site 20-mm away from the center. Further, the hardness of the section between the center of the head top portion and the site 20-mm away from the center in the width direction increases gradually from the center towards the outer side of the width direction. Furthermore, the difference between the actual hardness of the section, and the hardness obtained by interpolating the hardness of the center of the head top portion and the hardness of the site 20-mm away from the center in the width direction by straight line, is 10 or less in Brinell hardness.

The reason for defining the hardness distribution at the head top portion is as follows.

The contact width between a wheel and a rail is at its smallest value (about 10 mm for high-axle load railroad) when they are new or just after ground and corrected, and as the fitting progresses due to wear, the width gradually increases. Accordingly, the contact force is dispersed, and the contact stress distribution changes gradually to be flat. The relationship between the contact stress distribution and the hardness distribution during the fitting process was examined in several versions in terms of numeral value simulation.

Figure 5:
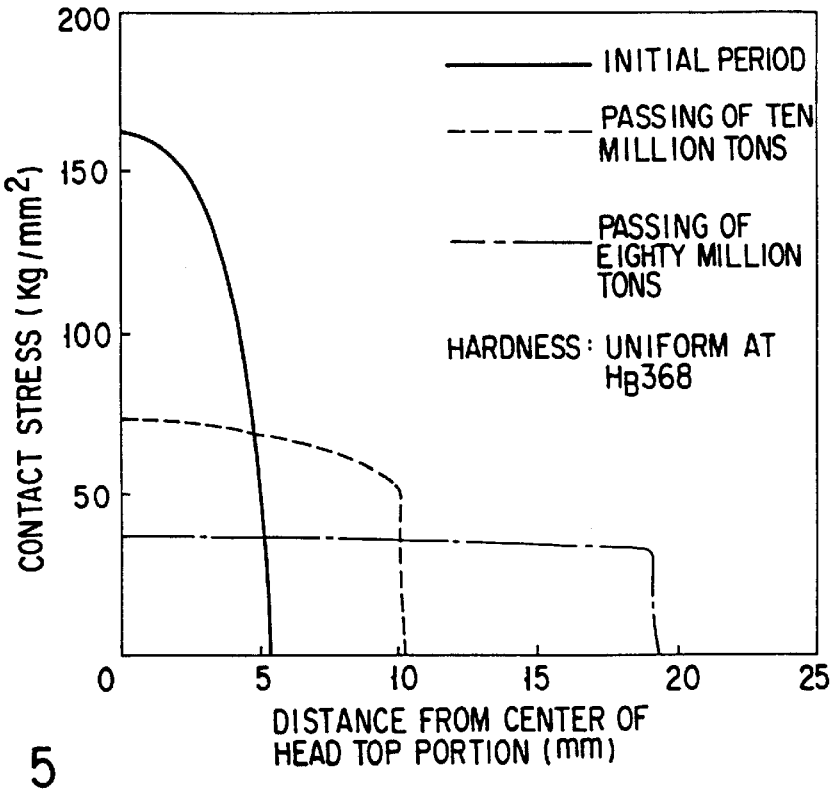
FIG. 5 is a graph showing variations of contact stress distributions, which take place as the fitting proceeds due to the wear in a rail having a uniform hardness.

FIG. 5 shows a contact stress distribution in the width direction, of a rail whose hardness at its head top portion is $H_B$368 and uniform. In FIG. 5, only the right half portion from the center of the head top portion is shown.

As is clear from this figure, a large contact stress acts on the center of the head top portion when the rail is new, or in the initial period of use just after being ground and corrected, and the contact stress distribution changes gradually to become flat as the fitting progresses due to wear. However, even if the fitting progresses to a certain degree, the contact stress is maximum always at the center of the head top portion. Therefore, the fatigue accumulation is concentrated at the center of the head top portion, and damage such as a head check occurs at the center of the head top portion.

Figure 6:
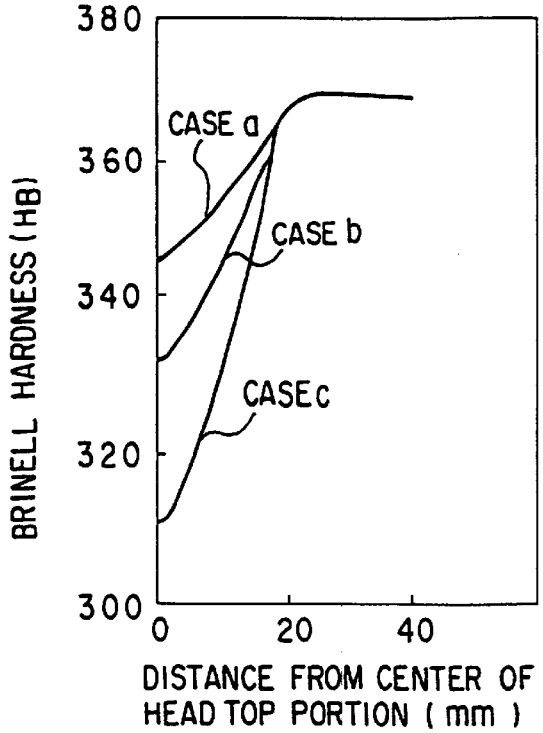
FIG. 6 is a graph showing three types of hardness distributions of head top portions, whose variations of the contact stress distributions were examined.

Next, head top portions having three types of hardness distributions (cases a, b and c) as shown in FIG. 6 were examined in terms of contact stress distribution. In the case a, the hardness of the center of the head top portion is 25 lower than the hardness of the site 20-mm away from the center in the width direction in Brinell hardness, in the case b, the hardness of the center is 40 lower, and in the case c, the hardness of the center is 60 lower.

Figure 7:
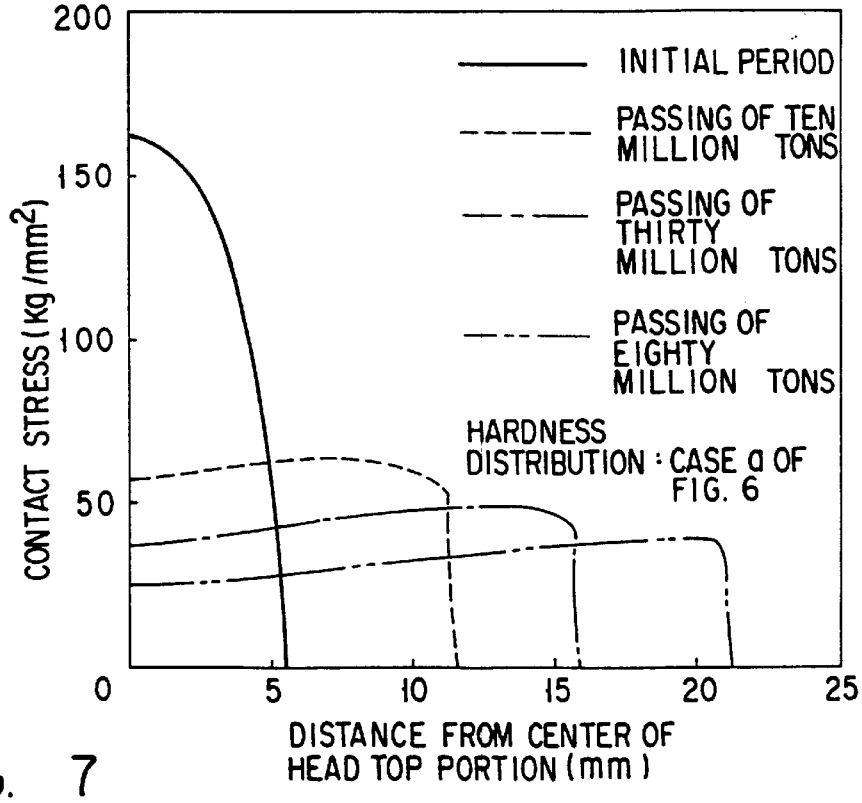
FIG. 7 is a graph showing contact stress distributions of the case where the fitting progresses due to the wear in the rail of the present invention.
Figure 8:
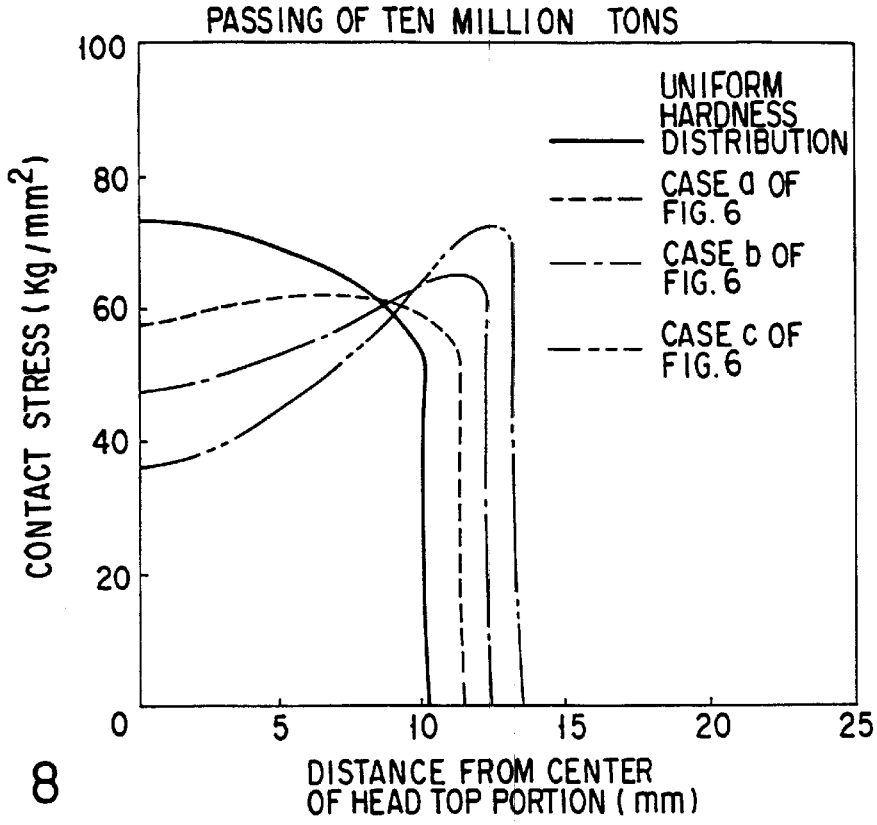
FIG. 8 is a graph showing contact stress distributions of the head top portions of the rail according to the present invention, the control rail, and the rail having the uniform hardness distribution, generated at passing of ten million tons.
Figure 9:
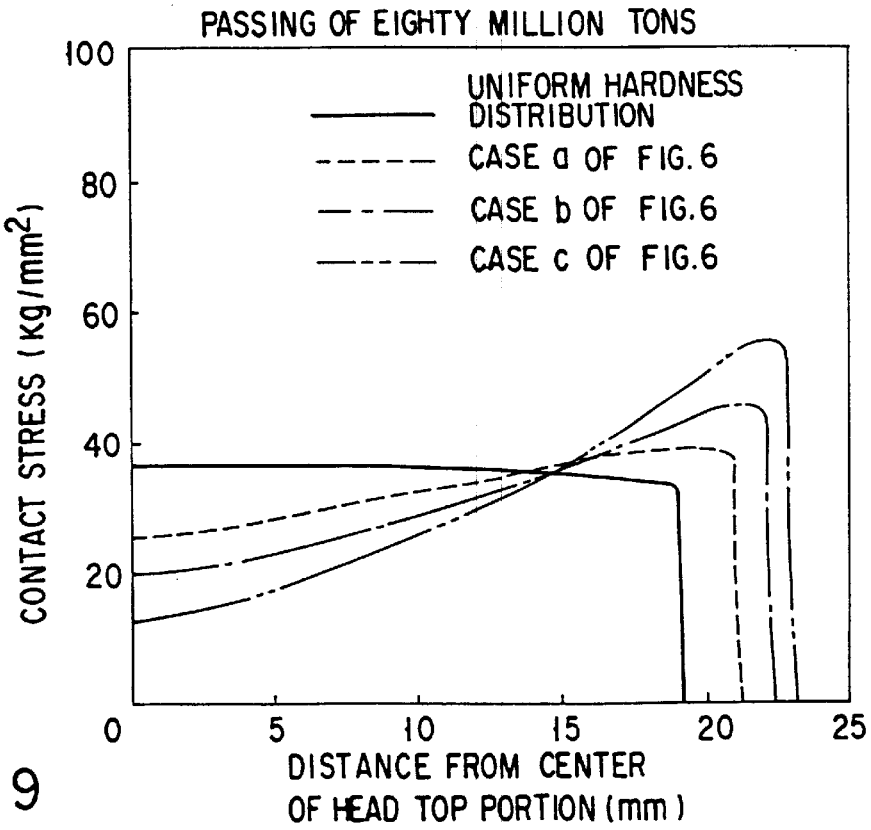
FIG. 9 is a graph showing contact stress distributions of the head top portions of the rail according to the present invention, the control rail, and the rail having the uniform hardness distribution, generated at passing of eighty million tons.

FIG. 7 shows the contact stress distribution of the case a, and FIGS. 8 and 9 show contact stress distributions at passing of ten million tons and eighty million tons, respectively, of the cases a to c, in comparison with the rail having a uniform hardness shown in FIG. 5.

As is clear from the comparison between FIGS. 5 and 7, the contact stress at the center of the head top portion of the rail of the case a, decreases in a short period of time as compared to the rail having the uniform hardness. This is because the hardness at the center is low, and the wear progresses more rapidly at the center than the peripheral portions. Thus, the fatigue accumulation at the center of the head top portion can be significantly reduced.

At the same time, as shown in FIG. 7, the contact stress at the end portion of the contact portion increases by the amount corresponding to the decrease in the contact stress at the center of the head top portion, and the peak of the contact stress shifts from the center of the head top portion to the end portion of the contact portion. Consequently, the fatigue accumulation increases at the end portion. However, as the fitting progresses due to wear, the site where the contact stress is at maximum, shifts gradually from the center of the head top portion to the end portion in the rail width direction. That is, the site on which the maximum fatigue accumulation acts, moves as the fitting progresses, thus dispersing the fatigue accumulation. Therefore, as a while, damage to the rail can be reduced.

The inventors of the present invention have found in the course of intensive studies that the phenomenon that the contact stress of the center of the head top portion decreases and the peak position of the contact stress moves, depends mostly on the hardness distribution of the section from the center of the head top portion to the site 20-mm away from the center in the width direction. In the case where the hardness of this section increases gradually and substantially linearly from the center of the head top portion towards the outer side of the width direction, the above-described phenomenon occurs smoothly. However, if there is a site where, for example, the hardness changes its usual manner from increasing to decreasing, the contact stress at the site increases excessively, causing damage.

Therefore, it is defined in the present invention that the hardness of the section between the center of the head top portion and the site 20-mm away from the center in the width direction increases gradually from the center towards the outer side of the width direction, and the difference between the actual hardness of the section, and the hardness obtained by interpolating the hardness of the center of the head top portion and the hardness of the site 20-mm away from the center in the width direction by straight line, is 10 or less in Brinell hardness.

As is clear from the comparison of the cases a to c shown in FIGS. 8 and 9, if the difference between the hardness of the center of the head top portion and that of the site 20-mm away from the center in the width direction becomes large, the peak of the contact stress acting on the end portion of the contact portion is rendered high. In the case c in which the difference in hardness is 60 in Brinell hardness, the peak value of the contact stress is remarkably raised as shown in these figures, causing damage. Therefore, it is defined in the present invention that the upper limit of the difference between the hardness of the center of the head top portion and that of the site 20-mm away from the center in the width direction is 50 in Brinell hardness.

On the other hand, if the difference between the hardness of the center of the head top portion and that of the site 20-mm away from the center in the width direction is 10 or less, such a contact stress distribution to decrease the damage will not be sufficiently exhibited. Therefore, the lower limit of the difference in hardness is set to 10 in Brinell. A preferable range of the difference between the hardness of the center of the head top portion and that of the site 20-mm away from the center in the width direction is 15 to 40 in Brinell hardness.

The hardness at the site 20-mm away from the center in the width direction is set to be in a range of $H_B$341 to $H_B$405 for the same reason as of setting the hardness of the corner portions and head side portions. Although the hardness of the section between the corner portion and the site 20-mm away from the center in the width direction does not have a great influence on the contact stress, it is preferable that the hardness should not greatly vary, but be substantially uniform, or smoothly and gradually change.

In the case where the hardness distribution is asymmetrical at the center of the head top portion, the above conditions must be satisfied on both sides of the asymmetry.

In the actual production, a slight variation of the hardness is inevitable, and therefore there may be some sites where the hardness does not successively increase in the width direction in terms of a micro-sense. However, in the present invention, it suffices only if the hardness increases successively in terms of a macro-sense.

With regard to the hardness in the depth direction, it is preferable that the surface portion of a depth of at least 10 mm from the head top surface, possibly down to 23 mm, should satisfy the hardness conditions of the present invention within its horizontal cross section. With this constitution, even if the wear of the rail remarkably progresses, the damage can be decreased.

In the circumstances where the contact conditions between a wheel and a rail are not so severe as in the case of a gentle curve, the range of the hardness at the head side portion, the corner portions and the site 20-mm away from the center of the head top portion can be lowered to $H_B$320 to $H_B$380.

According to the present invention, the strength and anti-wear property of the rail are maintained by increasing the hardness of the head side portions, the corner portions, and the sections between the site 20-mm away from the center of the head top portion in the width direction and the corner portions, to a sufficient degree. In the head top portion, the hardness of the center thereof is rendered lower than that of the site 20-mm away from the center in the width direction, and the hardness at a mid position between the center and the site is adjusted to vary substantially linearly, and as the fitting progresses due to wear, the contact stress of the center portion of the head top portion, which has a high wear rate, decreases, thus suppressing the damage to that portion. Further, the wear rate of the head top portion is appropriately controlled in the width direction, and therefore the peak value of the contact stress acting on the end of the contact portion is not rendered so high. Also, the peak position moves, and the fatigue accumulation does not concentrate on one point, but disperses over the head top surface. Therefore, the fatigue damage is suppressed, and the number of times of grinding can be reduced. Consequently, the maintenance cost of the track can be reduced, and the life of the rail can be prolonged.

EMBODIMENTS

Examples of the present invention will now be described.

Steel materials having compositions listed in TABLE 1, all of which fall within a range of the rail composition according to the present invention, were used as rail elements.

A 60-kg rail stock formed of steel A in TABLE 1 was subjected to conventional slack-quenching of the head portion, thus preparing a conventional hard head rail, and another rail stock of the same type was subjected to special slack-quenching of the head portion, in which head cooling was weakened, thus preparing a rail according to the present invention.

Figure 10:
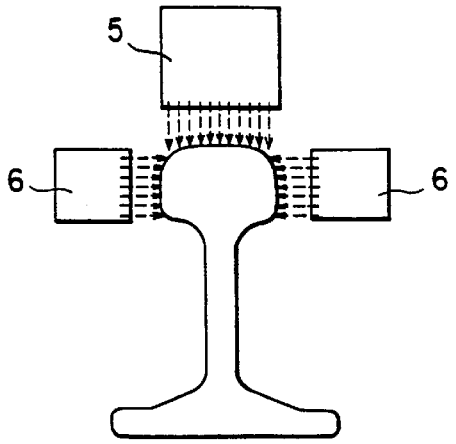
FIG. 10 is an explanatory view illustrating a method of cooling a rail element.
Figure 11A:
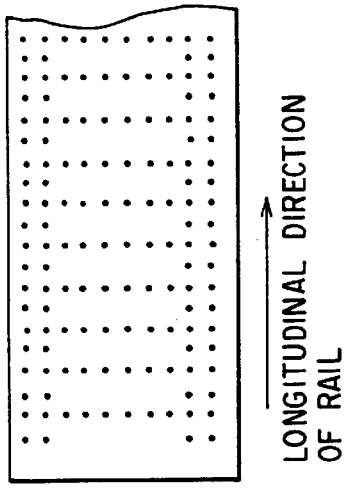
FIGS. 11A and 11B are diagrams showing the arrangements of nozzle holes of rail head top portion-cooling header used in the rail cooling method of the present invention, and a conventional method, respectively.
Figure 11B:
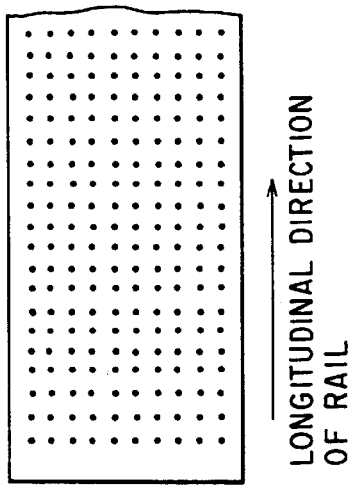
PRIOR ART FIG. 11B

A rail according to the present invention was manufactured as follows. After a rail stock was prepared by hot rolling, by use of an air header 5 for cooling a head top portion and an air header 6 for cooling a head side portion, arranged in the manner shown in FIG. 10, air was supplied from a plurality of nozzles of the air header 5 and 6 to the head of the rail stock which was in $Ar_1$ temperature or higher, so as to cool the rail stock. FIG. 11A shows the arrangement of the nozzle holes formed in the head top portion-cooling air header 5. As shown in this figure, the central portion of the header has a fewer number of nozzle holes than the other portion. In other words, as compared to the conventional head top portion-cooling header in which nozzle holes are uniformly formed as shown in FIG. 11B, in the resent invention, the number of nozzle holes in the central portion of the header was reduced to decrease the amount of air applied on the rail head top portion. Further, the pressure of the air of the header was controlled so that the air pressure ejected on the head top portion is set lower than that for the head side portions.

Figure 12:
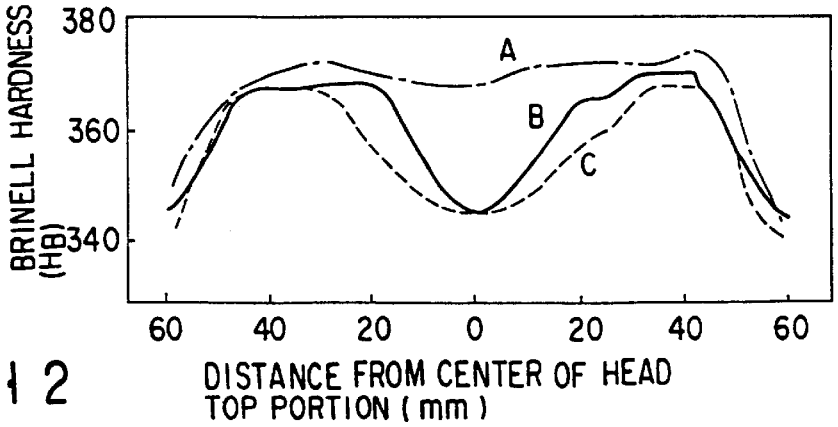
FIG. 12 is a diagram showing examples (reference letters B and C) of the hardness distribution of the rail according to the present invention, and the hardness distribution (reference letter A) of the conventional rail.

FIG. 12 shows the hardness distributions of portions at a depth of 1 mm from the rail head top portions of the rail samples. In FIG. 12, reference symbol A represents a hardness distribution of the conventional rail, and each of reference symbols B and C represents a hardness distribution of the rail of the present invention. Note that the width of the portion of the head top portion-cooling nozzle head 5 shown in FIG. 11A and used for manufacturing the rail represented by reference symbol B, was rendered smaller than that of the nozzle header used for manufacturing the rail of reference symbol C.

As is clear from FIG. 12, the conventional rail A has a substantially uniform hardness distribution in the section between the corner portion to the center of the head top portion, whereas the rails B and C of the present invention have the following hardness distributions. That is, in the rail B, the hardness of the center of the head top portion is 23 (in Brinell hardness) lower than that of the left-hand side site 20-mm away from the center in the width direction, and 21 lower than that of the right-hand side site. In the rail C, the hardness of the center was 11 lower than that of the left-hand side site, and 13 lower than that of the right-hand side site. In both rails B and C, the hardness gradually increased from the center of the head top portion towards the site 20-mm away from the center in the width direction. Further, the difference between the actual hardness of the section, and

TABLE 1

| Steel Type | C | Si | Mn | P | S | Ni | Cr | Mo | Nb | V | sol. Al |
|---|---|---|---|---|---|---|---|---|---|---|---|
| A | 0.79 | 0.45 | 0.95 | 0.021 | 0.005 | — | 0.20 | — | — | 0.06 | 0.001 |
| B | 0.80 | 0.30 | 1.21 | 0.017 | 0.006 | — | 0.22 | — | — | — | 0.007 |
| C | 0.79 | 0.61 | 0.84 | 0.006 | 0.008 | — | 0.45 | — | — | 0.05 | 0.005 |
| D | 0.79 | 0.19 | 0.98 | 0.017 | 0.007 | — | 0.22 | — | — | 0.03 | 0.001 |
| E | 0.78 | 0.54 | 0.85 | 0.013 | 0.006 | 0.11 | 0.45 | — | 0.04 | — | 0.004 |
| F | 0.76 | 0.23 | 0.90 | 0.018 | 0.008 | — | 0.16 | 0.08 | — | 0.06 | 9.002 |
| G | 0.77 | 0.23 | 0.91 | 0.019 | 0.008 | — | — | — | — | — | 0.004 |

the hardness obtained by interpolating the hardness of the center of the head top portion and the hardness of the site 20-mm away from the center in the width direction by straight line, is 6 or less in the rail B, and 4 or less in the rail C.

Next, the rail stocks listed in TABLE 1 were processed into disks having a width of 50 mm, and the disks were heated, and then subjected to a treatment similar to the above rail cooling method, in which cooling of the central portion of the disk side surface was weakened as compared to that of the corner portions, thus preparing cylindrical test pieces each having a hardness distribution in the width direction of the disk. The hardness distributions of the test pieces are shown in TABLE 2. In the preparation of the test pieces, the cooling method was controlled to create various hardness distributions in the width direction, thus preparing those having the hardness distribution within a range defined by the present invention (examples) and those having a hardness distribution falling out of the range of the present invention (comparative examples). Further, with steel A, the cooling control was not carried out, and a rail having a uniform hardness (conventional example), corresponding to the conventional rail, was prepared.

These test pieces were examined in terms of damage life, using a 2-cylinder rolling tester. The hardness of the test piece of the wheel was about $H_B$331. The results of the test are shown in TABLE 2. In TABLE 2, the damage life of each test piece is expressed in ratio with respect to the damage life of the test piece corresponding to the conventional rail having a uniform hardness.

TABLE 2

| Steel type | Hardness of center of head top portion $H_B$ | Hardness of site 20-mm away from center of head top portion $H_B$ | Difference in hardness $H_B$ | Difference between hardness of center and linearly interpolated hardness (maximum) $H_B$ | Rate of damage life with regard to conventional rail | Remarks |
|---|---|---|---|---|---|---|
| A | 367 | 370 | 3 | 2 | 1.0 | Prior art example |
| | 345 | 359 | 14 | 3 | 1.4 | |
| | 346 | 366 | 20 | 6 | 1.8 | Example |
| | 355 | 389 | 34 | 9 | 1.8 | |
| | 306 | 362 | 56 | 13 | 1.1 | Comparative example |
| B | 363 | 368 | 5 | 2 | 1.1 | Comparative example |
| | 337 | 348 | 11 | 2 | 1.3 | |
| | 340 | 361 | 21 | 8 | 1.5 | Example |
| | 331 | 368 | 37 | 9 | 1.8 | |
| | 296 | 352 | 56 | 16 | 0.9 | Comparative example |
| C | 370 | 386 | 16 | 4 | 1.5 | |
| | 363 | 390 | 27 | 6 | 1.9 | Example |
| | 326 | 380 | 54 | 14 | 1.1 | Comparative example |
| D | 361 | 363 | 2 | 2 | 6.9 | Comparative example |
| | 339 | 352 | 13 | 4 | 1.3 | |
| | 340 | 365 | 25 | 6 | 1.7 | Example |
| E | 367 | 370 | 3 | 2 | 1.1 | Comparative example |
| | 338 | 360 | 22 | 5 | 1.7 | |
| | 356 | 387 | 31 | 5 | 1.9 | Example |
| | 332 | 387 | 55 | 13 | 1.1 | Comparative example |
| F | 356 | 381 | 25 | 6 | 1.9 | Example |
| G | 344 | 347 | 3 | 2 | 0.8 | Comparative example |
| | 341 | 361 | 20 | 6 | 1.7 | Example |

As shown in TABLE 2, with the examples each having a hardness distribution within the range defined by the present invention, the damage life was improved 1.3 times or more than that of the convention example, with the maximum improvement of 1.9 times.

It was thus confirmed from the results of the test that the hardness distribution of the head top portion defined in the present invention, with which the contact stress of the central portion of the head top portion can be reduced, the peak value of the contact stress acting on the end of the contact portion can be suppressed, and the fatigue accumulation can be dispersed by moving the peak position from the center of the head top portion towards the outer side of the width direction, is effective for prolonging the damage life.

As described, according to the present invention, damage to the head top portion, which occurs due to a excessive contact pressure such as head check, can be suppressed; therefore the life of the rail can be prolonged. Thus, the drawback of the conventional technique raised when a highly rigid track in which concrete crossties are used in a sharp curve of a high-axle load railroad, is introduced, can be solved, and the track maintenance cost can be reduced. Consequently, the rail of the present invention having an excellent anti-wear property and an excellent damage-resistance, is expected to be very effective for reducing maintenance cost of a railroad along with the popularization of the highly rigid track in the future. Thus, the present invention is very valuable in terms of economy.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A high-strength, high damage-resistant rail consisting essentially of 0.6 to 0.85 wt % of C, 0.1 to 1.0 wt % of Si, 0.5 to 1.5 wt % of Mn, 0.035 wto or less of P, 0.040 wt % or less of S, and 0.05 wt % or less of Al, the balance being Fe and inevitable impurities, and comprising a corner portion and a head side portion, each having a Brinell hardness of 341 to 405, and a head top portion in which a Brinell hardness of a site 20 mm distant from a central portion of the head top portion in a width direction is 341 to 405, and a hardness of the central portion of the head top portion is at least 10 lower in Brinell hardness than that of the site 20-mm distant from the central portion, and a ratio of $$\text{the difference between}\begin{pmatrix}\text{the Brinell hardness of}\\ \text{the central portion of}\\ \text{the head top portion}\end{pmatrix}\text{and}\ \frac{\begin{pmatrix}\text{the Brinell hardness of}\\ \text{the site 20-mm distant}\\ \text{from the central portion}\end{pmatrix}}{\begin{pmatrix}\text{the Brinell hardness of the site}\\ \text{20-mm distant from the central portion}\end{pmatrix}}$$

being 0.1 or less, a hardness of a section between the central portion of the head top portion and the site 20-mm distant from the center in the width direction increases gradually from the central portion towards an outer side of the width direction, and a difference between an actual hardness of the section, and a hardness obtained by interpolating the hardness of the central portion of the head top portion and the hardness of the site 20-mm distant from the center in the width direction by a straight line, is 10 or less in Brinell hardness.

2. A high-strength, high damage-resistant rail consisting essentially of 0.6 to 0.85 wt % of C, 0.1 to 1.0 wt % of Si, 0.5 to 1.5 wt % of Mn, 0.035 wt % or less of P, 0.040 wt % or less of S, and 0.05 wt % or less of Al, and at least one element selected from the group consisting of 0.05 to 1.5 wt % of Cr, 0.01 to 0.20 wt % of Mo, 0.01 to 0.10 wt % of V, 0.1 to 1.0 wt % of Ni and 0.005 to 0.15 wt % of Nb, the balance being Fe and inevitable impurities, and comprising a corner portion and a head side portion, each having a Brinell hardness of 341 to 405, and a head top portion in which a Brinell hardness of a site 20-mm distant from a central portion of the head top portion in a width direction is 341 to 405, and a hardness of the central portion of the head top portion is at least 10 lower in Brinell hardness than that of the site 20-mm distant from the central portion, a ratio of $$\text{the difference between}\begin{pmatrix}\text{the Brinell hardness of}\\ \text{the central portion of}\\ \text{the head top portion}\end{pmatrix}\text{and}\ \frac{\begin{pmatrix}\text{the Brinell hardness of}\\ \text{the site 20-mm distant}\\ \text{from the central portion}\end{pmatrix}}{\begin{pmatrix}\text{the Brinell hardness of the site}\\ \text{20-mm distant from the central portion}\end{pmatrix}}$$

being 0.1 or less, a hardness of a section between the central portion of the head top portion and the site 20-mm distant from the center in the width direction increases gradually from the central portion towards an outer side of the width direction, and a difference between an actual hardness of the section, and a hardness obtained by interpolating the hardness of the central portion of the head top portion and the hardness of the site 20-mm distant from the center in the width direction by a straight line, is 10 or less in Brinell hardness.

3. The high-strength, high damage-resistant rail of claim 2, wherein the rail consists essentially of 0.79 wt % C, 0.45 wt % Si, 0.95 wt % Mn, 0.021 wt % P, 0.005 wt % S, 0.20 wt % Cr, 0.06 wt % V, 0.001 sol.Al and the balance being Fe.

4. The high-strength, high damage-resistant rail of claim 2, wherein the rail consists essentially of 0.80 wt % C, 0.30 wt % Si, 1.21 wt % Mn, 0.017 wt % P, 0.006 wt % S, 0.22 wt % Cr, 0.007 wt % sol.Al and the balance being Fe.

5. The high-strength, high damage-resistant rail of claim 2, wherein the rail consists essentially of 0.79 wt % C, 0.61 wt % Si, 0.84 wt % Mn, 0.006 wt % P, 0.008 wt % S, 0.45 wt % Cr, 0.05 wt % V, 0.005 wt % sol.Al and the balance being Fe.

6. The high strength, high damage-resistant rail of claim 2, wherein the rail consists essentially of 0.79 wt % C, 0.19 wt % Si, 0.98 wt % Mn, 0.017 wt % P, 0.007 wt % S, 0.22 wt % Cr, 0.03 wt % V, 0.001 wt % sol.Al and the balance being Fe.

7. The high-strength, high damage-resistant rail of claim 2, wherein the rail consists essentially of 0.78 wt % C, 0.54 wt % Si, 0.85 wt % Mn, 0.013 wt % P, 0.006 wt % S, 0.11 wt % Ni, 0.45 wt % Cr, 0.04 wt % Nb, 0.004 wt % sol.Al and the balance being Fe.

8. The high-strength, high damage-resistant rail of claim 2, wherein the rail consists essentially of 0.76 wt % C, 0.23 wt % Si, 0.90 wt % Mn, 0.018 wt % P, 0.008 wt % S, 0.16 wt % Cr, 0.08 wt % Mo, 0.06 wt % V, 0.002 wt % sol.Al and the balance being Fe.

9. The high-strength, high damage-resistant rail of claim 1, wherein the rail consists essentially of 0.77 wt % C, 0.23 wt % Si, 0.91 wt % Mn, 0.019 wt % P, 0.008 wt % S, 0.004 wt % sol.Al and the balance being Fe.

10. The high-strength, high damage-resistant rail of claim 3, wherein the Brinell hardness of the center of the head top portion is 345 to 355; and the Brinell hardness of the site 20-mm away from the center of the head top portion is 359 to 389.

11. The high-strength, high damage-resistant rail of claim 4, wherein the Brinell hardness of the center of the head top portion is 331 to 340; and the Brinell hardness of the site 20-mm away from the center of head top portion is 348 to 368.

12. The high-strength, high damage-resistant rail of claim 5, wherein the Brinell hardness of the center of the head top portion is 363 to 370; and the Brinell hardness of the site 20-mm away from the center of head top portion is 386 to 390.

13. The high-strength, high damage-resistant rail of claim 6, wherein the Brinell hardness of the center of the head top portion is 339 to 340; and the Brinell hardness of the site 20-mm away from the center of head top portion is 352 to 365.

14. The high-strength, high damage-resistant rail of claim 7, wherein the Brinell hardness of the center of the head top portion is 338 to 356; and the Brinell hardness of the site 20-mm away from the center of head top portion is 360 to 387.

15. The high-strength, high damage-resistant rail of claim 8, wherein the Brinell hardness of the center of the head top portion is 356; and the Brinell hardness of the site 20-mm away from the center of head top portion is 381.

16. The high-strength, high damage-resistant rail of claim 9, wherein the Brinell hardness of the center of the head top portion is 341; and the Brinell hardness of the site 20-mm away from the center of the head top portion is 361.

17. The high-strength, high damage-resistant rail of claim 1, wherein said ratio is 0.09 or less.

18. The high-strength, high damage-resistant rail of claim 2, wherein said ratio is 0.09 or less.

19. The high-strength, high damage-resistant rail of claim 1, wherein the difference in Brinell hardness between the central portion of the head top portion to the site 20-mm distant away from the central portion is 15 to 40.

20. The high-strength, high damage-resistant rail of claim 2, wherein the difference in Brinell hardness between the central portion of the head top portion to the site 20-mm distant away from the central portion is 15 to 40.

21. The high-strength, high damage-resistant rail of claim 1, wherein the hardness of the central portion of the head top portion is at least 10 to 50 lower in Brinell hardness, than that of the site 20-mm distant from the central portion.

22. The high-strength, high damage-resistant rail of claim 2, wherein the hardness of the central portion of the had top portion is at least 10 to 50 lower in Brinell hardness, than that of the site 20-mm distant from the central portion.

* * * * *